United States Patent [19]

Buckshaw

[11] Patent Number: 5,017,148

[45] Date of Patent: May 21, 1991

[54] SAFETY CAP FOR ELECTRICAL OUTLET

[76] Inventor: Dennis J. Buckshaw, 9610 Melrose, Livonia, Mich. 48154

[21] Appl. No.: 592,596

[22] Filed: Oct. 4, 1990

[51] Int. Cl.[5] ..... H01R 13/44

[52] U.S. Cl. ..... 439/148; 439/135

[58] Field of Search ..... 439/135, 142, 148, 149, 439/136, 137, 371, 373, 451; 174/66, 67

[56] References Cited

U.S. PATENT DOCUMENTS

| | | | |
|---|---|---|---|
| 2,932,811 | 4/1960 | Abraham et al. | 439/148 |
| 3,131,014 | 4/1964 | Munoz et al. | 439/148 |
| 3,389,367 | 6/1968 | Schwartz | 439/148 |
| 4,293,173 | 10/1981 | Tricca | 439/148 |
| 4,731,032 | 3/1988 | Noorily | 439/148 X |

FOREIGN PATENT DOCUMENTS

| | | | |
|---|---|---|---|
| 1062304 | 7/1959 | Fed. Rep. of Germany | 439/135 |

*Primary Examiner*—Neil Abrams
*Assistant Examiner*—Khiem Nguyen
*Attorney, Agent, or Firm*—Krass & Young

[57] ABSTRACT

A safety cover apparatus for an electrical outlet being secured to the face plate screw. The safety cover comprising a pair of safety plugs and a tether connecting the two safety plugs together. Each plug has a plug face plate and a pair of prongs integrally attached to the plug face plate. The tether has an aperture located halfway between the two safety plugs so the safety cover screw can be used to attach the device to the outlet. The length of the tether allows the safety plug to be folded over the tether as to dispose the tether between the prongs and the prongs in the terminals of an electrical socket. The fold is operative in removing the plug from the socket.

6 Claims, 1 Drawing Sheet

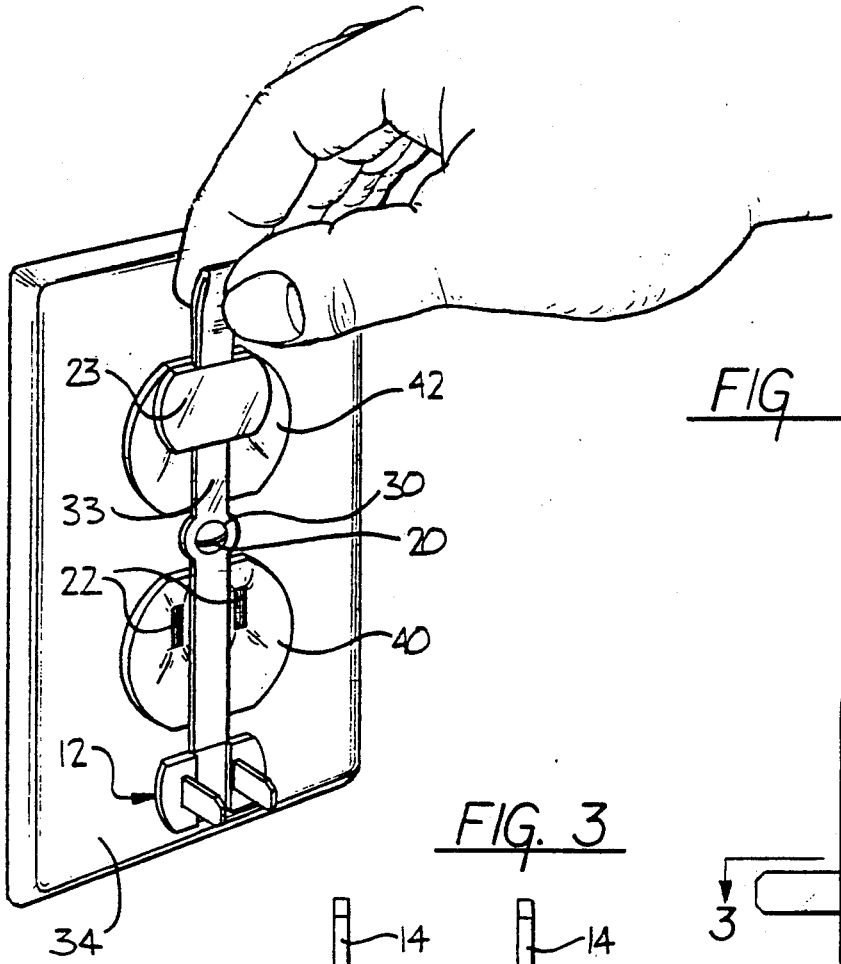
FIG 1
FIG. 2
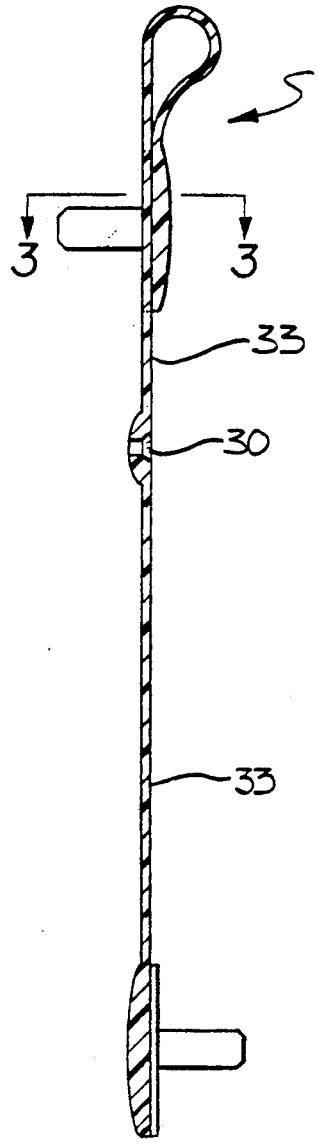
FIG. 3
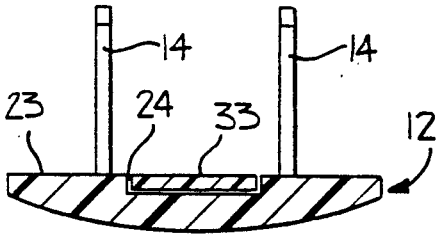
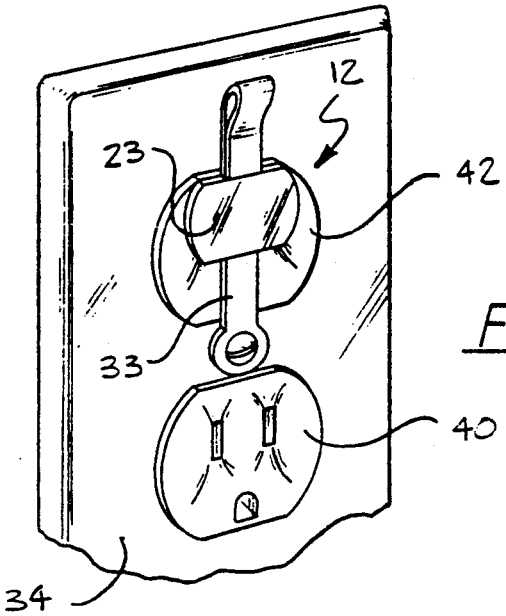
FIG. 4

SAFETY CAP FOR ELECTRICAL OUTLET

INTRODUCTION

This invention generally relates to safety caps for electrical wall outlets and more particularly to a cap which remains attached to the outlet when not in use.

BACKGROUND

Small children can be protected against shock and injury by plugging electrical outlets so that metal objects cannot be easily inserted into the plug holes.

The prior art includes several safety plug devices consisting of caps having electrically non-conducting prongs which can be inserted into the outlet holes. One such device is disclosed in the Tricca patent No. 4,293,173. A shortcoming of Tricca is that it has no means to attach the plug to the outlet when not in use. Accordingly, it is likely that the Tricca cap will quickly be misplaced and/or lost. This, of course, completely defeats its purpose.

Three patents have been discovered which relate to the disclosed invention. They are: Koehler's Patent No. 4,408,813, F. W. Schwartz Patent No. 3,389,367, and Abraham's Patent No. 2,932,811. These three patents include safety plugs attached to standard extension cords and safety plugs attached to electrical wall outlets.

Koehler discloses a safety plug and tether for an electrical extension cord. The tether 40 is integral with the housing 12. Koehler uses a tab at the remote edge of the insulating cover 36 to remove the safety plug. This tab is small and makes removal of the device difficult. Koehler does not use the tether as a tab to facilitate the removal of the plug. In addition, Koehler relates to extension cords rather than permanent electrical outlets.

Schwartz discloses a plastic plug 15 and a plate portion 18 which permits the device 15 to be secured to an extension cord. The hinges 21 and 25, effectively act as a flexible tether as illustrated in Koehler. The plates 19 and 20 are the same width as the covers, 22 and 24, making it difficult to use, if not impossible, as an aid in removing the plug from the extension cord.

Lastly, Abraham discloses a safety cover for an electrical outlet, where the safety cover is attached to the outlet by receiving the face plate screw of the outlet through an aperture midway between the two plugs 10 and 12. While the Abraham device keeps the safety cover in place when not in use, it is difficult to use because of the close proximity of the plugs 10, and 12 to the outlet. The plugs, 10 and 12, cannot be effectively removed from the area immediate to the socket. The lack of an effective tab also makes Abraham's plug difficult to remove from the socket.

All of the prior art devices are different to remove from the socket. None of the prior art teaches the use of the tether as a tab to enable the plug to be easily removed.

SUMMARY OF INVENTION

The present invention is an electrical safety cover to be used on standard electrical outlets. The safety cover comprises: a safety cover plate, a pair of prongs integral with the safety cover plate, and a tether integrally attached to the safety cover plate. The prongs simulate the prongs of a standard electrical appliance plug so they may be easily received by the terminals of an electrical outlet. The device is unitary and constructed of an electrically non-conducting material such as plastic. The tether has an aperture remotely spaced from the safety plug, for attachment to the face plate screw. The length of the tether is substantially greater than the distance between the face plate screw and the terminals of the outlet, and the prongs project away from the outlet when not in use. Because of the length of the tether and the orientation of the prongs, the plug is folded over onto the tether for insertion, thereby disposing the prongs forward the terminals and the tether lies between the prongs such that the tether's longitudinal axis remains unchanged. The fold further defines a tab which can be used to remove the plug from the outlet.

In the preferred form the device comprises two safety plugs reversely symmetrically arranged about a connecting strap.

BRIEF DESCRIPTION OF THE DRAWINGS

FIG. 1 is a perspective view of the safety cover of the invention.

FIG. 2 is a cross-sectional view of the safety cover of FIG. 1.

FIG. 3 is a cross-sectional view through the cover plate.

FIG. 4 is a perspective view of a second embodiment of the safety cover.

DESCRIPTION OF THE PREFERRED EMBODIMENTS

Referring now to the drawing and more particularly to FIGS. 1–2, there is shown an electrical outlet safety cover, generally designated as 10, for use with electrical outlets. The electrical outlet, 16, has two sockets 40 and 42. Each socket has two terminals 22. There is a face plate 34 covering the rearward portion of the sockets 40 and 42, and is attached to the outlet by the face plate screw 20. A standard duplex outlet is illustrated where the face plate screw is located between the two sockets.

The electrical outlet safety cover 10 is included to be used in the above-mentioned environment and is characterized in having a safety plug 12, and a tether 32. The safety cover may be in a single format, as in FIG. 4, or a dual format. The dual format has two safety plugs 12, each safety plug being positioned at an end of the tether 33. In the single format there is only one safety plug 12 attached to the tether 32, and the tether terminates after the aperture 30. The dual format of the invention is the preferred one.

The cross section taken from the line 3—3 from FIG. 2 shows the safety plug 12 in the installed condition. Each safety plug has a plug cover plate 23 and a pair of prongs 14 which are integrally attached to the plug cover plate 23. The plug cover plate 23 has a generally planar surface, and is of substantially rectangular shape. The prongs 14, are spaced away from each other at a sufficient distance as to be received by the terminals 22 of the sockets 40 and 42. Located on the planar surface is a groove 24 of the plug cover plate 23. The groove, 24, is located between the prongs 14, and extends between the edges of the plug cover plate 23 along the longitudinal axis of the tether 32. The groove is slightly wider than the tether 32, and is slightly deeper than the tether 33 is thick. The groove receives the tether 33 when the safety plug is in place.

As seen in FIG. 2, the tether 33 extends between the safety plugs 12. The tether, 33, is integrally molded with the plug cover plate 23 of each safety plug. The aperture 30 is centrally located on the tether 33, halfway between the two safety plugs. The aperture 30 is configured as to receive the face plate screw 20 so that the device, 10, is retained on the outlet when not in use. In this particular embodiment, the tether 33 is ½ inch wide and the distance from the aperture 30 to each plug cover plate is 1½ inches.

The electrical outlet safety cover plate 10, is made out of an electrically non-conductive material; some examples are Nylon, polyethylene, high density polyethylene, polycarbonates, acrylics and polypropylene, but the preferred embodiment of the unit is made of polypropylene.

The device 10 may be manufactured in a unitary fashion as illustrated. Preferably the device 10 is made in an injection molding process. This allows easy manufacture of the device.

To install the device 10, the face plate screw 20 must be removed and the aperture 30 placed over the screw hole so that the screw 20 may be passed through the aperture and attached in place. The device 10, should be attached such that the prongs 14 extend away from the outlet 15.

To use the device, 10, one holds the plug cover plate 23 and folds the plug cover plate 18 over so that the tether 33 is disposed in groove 24 as seen in FIG. 2. The prongs 14 may then be aligned with the terminals as to insert the prongs 14 in the terminals 22 of the socket 16. To remove the plug, 12, from a socket 40,42, the fold 18, in the tether 33, may be held and pulled away from the socket, as seen in FIG. 1. The fold effectively acts as a tab whereby the plug may be easily removed.

When not in use, the plug may be easily removed from the immediate area of the appliance plug that may be put into the socket. The longer length of the tether enables the plug to be remote from the socket yet remains attached when not in use.

An alternative embodiment would be the single format as seen in FIG. 4 of the drawings of the invention. The single format would have one safety plug of the abovementioned characteristics attached to the tether 33. The aperature 20 is spaced 1½ inches away from the plug on the tether. The aperature could then define the end of the tether 33.

The previous description of the device, 10, is purely illustrative and not restrictive in any way. Certain changes would be obvious to one skilled in the art. Such obvious changes might include replacing the groove 24 with a series of straps.

I claim:

1. An electrical outlet safety cover of the type being made of an electrical non-conducting material such as plastic having an electrical socket safety plug having an essentially planar plug cover plate having a pair of prongs simulating a pair of prongs on a standard electrical appliance, which are adapted to be received in a pair of live terminals of a socket, said prongs projecting normally from said plug cover plate; and a flexible tether having said safety plug integrally formed at one end thereof and having an aperture remotely spaced from said safety plug for attachment to a conventional electrical outlet cover plate screw, characterized in that:

the length of the tether is substantially greater than the distance between the outlet cover plate screw and the terminals such that the prongs extend away from the outlet when unplugged and the safety plug may be folded over the tether to plug the prongs in the terminal sockets with the tether between the prongs, such that the longitudinal axis of the tether remains, the fold forming a tab operative to remove the prongs from said outlet.

2. An electrical outlet safety cover as in claim 1 having a second plug cover plate and prongs normal to said second plug cover plate and a second tether integrally molded to said second plug cover plate and said second tether projecting from longitudinal axis of said first tether so that said aperture is located at a point midway between said safety plugs.

3. An electrical outlet safety cover of the type being made of an electrically non-conducting material such as plastic having an electrical socket safety plug having an essentially planar plug cover plate having a pair of prongs simulating a pair of prongs on a standard electrical appliance, which are meant to be received by a pair of live terminals on a socket, said prongs projecting normally from said plug cover and a flexible tether having said plug cover plate is integrally formed at the end of said tether, and an aperture remotely spaced from said safety plug for attachment to a conventional outlet cover plate screw, characterized in that:

said plug cover plate has an elongated groove disposed between said prongs, said groove extending between the edges of said plug cover plate along the longitudinal axis of said tether; an the length of said tether being substantially greater than the distance between said outlet cover plate screw and said terminals, when installed said prongs extend away from the outlet operative to allow said safety plug to be folded over said tether to dispose said prongs in said terminals of said socket and said tether in said groove, said fold defining a tab operative in removing said prongs from said outlet.

4. An electrical outlet safety cover as in claim 3 having a second plug cover plate and prongs normal to said plug cover plate and a second tether integrally molded to said second plug cover plate, said second tether projecting from longitudinal axis of said first tether, so that said aperture is located at a point midway between said safety plug covers.

5. A safety cover for an electrical outlet of the type having a face plate, attached thereto by a screw, comprising:

a safety plug having a plug cover plate including a generally planar surface having a pair of prongs projecting perpendicular from said planar surface, said prongs being configured to be retainably received by a pair of live terminals on a socket, said planar surface having a groove located between said prongs extending between the edges of said plug cover plate, said pair of prongs and said plug cover plate being fabricated from an electrically insulating material; and a tether having a first end said first end being secured to said cover plate, an aperture remotely spaced from said first end on said tether configured as to receive the screw, said tether being at least 1½ inches long and said tether being at most ½ inch wide when installed said prongs extend away from the outlet operative to allow said safety plug to be folded over said tether to dispose said tether in said groove and to further dispose said prongs in the terminals, said fold defining a tab, whereby said tab is operative in removing said prongs from the outlet.

6. A safety cover as in claim 5 further comprising:

a second safety cover plate including a generally planar surface having a pair of prongs perpendicularly projecting from said planar surface, said prongs configured as to be retainably received by the terminal; and a second flexible tether extending along longitudinal axis of said first tether integrally molded to said second safety cover plate such that said aperture is located midway between said safety cover plate.

* * * * *